US007337928B2

(12) United States Patent
Jackman

(10) Patent No.: US 7,337,928 B2
(45) **Date of Patent: *Mar. 4, 2008**

(54) CARTRIDGE NOZZLE SEAL OPENED BY INTERNAL CARTRIDGE PRESSURE

(76) Inventor: Brian F. Jackman, 39 Park St., Hudson, MA (US) 01749

( * ) Notice: Subject to any disclaimer, the term of this patent is extended or adjusted under 35 U.S.C. 154(b) by 0 days.

This patent is subject to a terminal disclaimer.

(21) Appl. No.: 10/694,137

(22) Filed: Oct. 27, 2003

(65) Prior Publication Data

US 2005/0087570 A1 Apr. 28, 2005

(51) Int. Cl.
*B65D 5/72* (2006.01)

(52) U.S. Cl. ..... 222/494; 222/541.3; 222/541.4; 222/541.6

(58) Field of Classification Search ..... 222/153.05, 222/153.06, 541.3, 541.4, 327, 387, 494, 222/541.6

See application file for complete search history.

(56) References Cited

U.S. PATENT DOCUMENTS 2,646,906 A 7/1953 Jones
3,029,987 A 4/1962 Gronemeyer
3,071,294 A * 1/1963 Galbierz ..... 222/327
3,241,726 A * 3/1966 Chester ..... 222/211
4,356,935 A * 11/1982 Kamin ..... 222/1
4,830,231 A * 5/1989 Smith ..... 222/327
5,560,521 A * 10/1996 Boring et al. ..... 222/327
6,234,348 B1 * 5/2001 Okamura et al. ..... 222/1
6,457,613 B1 * 10/2002 Patterson ..... 222/494
6,578,737 B2 6/2003 Jackman

* cited by examiner

*Primary Examiner*—Philippe Derakshani

(57) ABSTRACT

A pressure activated self opening frangible closure seal is bonded over the interior nozzle opening of a pressure operated cartridge container used for storing and dispensing flowable material when pressurized in an application gun. The seal provides a leak proof closure that is strong enough to remain intact during the filling operation of the cartridge, and at the same weak enough to break open and dispense the contents out through the nozzle when a consumer pressurizes the cartridge with the application gun. The seal is constructed from a first layer of leak proof frangible sheet material that is bonded to a second layer of strengthening sheet material. The strengthening layer contains a cut out void configuration that forms a breaking pattern which forces the seal to break open only in the weaker single frangible layered configuration of the cut out void forming the breaking pattern when the cartridge is pressurized.

9 Claims, 7 Drawing Sheets

CARTRIDGE NOZZLE SEAL OPENED BY INTERNAL CARTRIDGE PRESSURE

FIELD OF THE INVENTION

The invention resides in the area of self opening container seals specifically an improved frangible sealing closure for the interior nozzle opening of pressure operated cartridge type dispensing containers that automatically bursts open in a defined configuration without any of the seal material contaminating the dispensed material when sufficient internal cartridge pressure is brought to bear against the seal by pressurizing the cartridge with an application gun.

BACKGROUND OF THE INVENTION

It is highly desirable and beneficial to provide pressure operated cartridge containers of the type used for storing and dispensing diverse products such as, sealants, adhesives, or lubricants and the like, and commonly known in the industry as a caulking cartridge, with an improved interior nozzle opening closure seal that includes a pressure activated self opening feature.

These types of containers can be constructed of diverse materials such as plastic, paperboard, or metal, or combinations of one or more of the above. They generally consist of a hollow cylindrical tube sealed at one end by a sliding interior piston, with an opposite end sealed by a wall end that incorporates a hollow plastic exterior dispensing nozzle with an interior opening in its base.

To dispense the contents the cartridge is loaded into an application gun comprised of a central body portion with one end forming a fixed perpendicular wall end that butts up against and holds the nozzle end of the cartridge. The opposite end of the gun incorporates a handle with a trigger that advances a mounted plunger into the bore of the cartridge when squeezed, thereby engaging and advancing the sliding interior piston which pressurizes the cartridge and forces the contents out through the dispensing nozzle.

Because the bore of these plastic cartridge nozzles generally taper to a point, filling equipment is usually unable to completely fill the dispensing nozzle with the container material, leaving an air pocket in the nozzle. Certain types of contained products when exposed to even a small amount of air can dry out in the cartridge and become unusable. Other types of contained products can be adversely affected when coming into contact with the plastic of the nozzle itself and require a metallic lined cartridge with a metal end cap and piston to maintain product usability. To overcome these drawbacks manufacturers added a metal foil seal that is bonded over the interior opening of the nozzle and is very effective in preventing the cartridge contents from being ruined by coming into contact with the plastic nozzle or any air trapped inside.

In order to dispense the cartridge contents, the user is required to follow three procedures. First, the cartridge is loaded into the application gun. Second, the nozzle has to be opened by cutting off the tip. And third, the foil seal inside the base of the nozzle has to be pierced to allow the cartridge contents to dispense out through the nozzle opening when the cartridge is pressurized.

The first two procedures are straight forward and easily accomplished, however, the third procedure is not. The user is required to provide a rod shaped tool that has to be thin enough to insert into the nozzle opening, long enough to reach the foil seal, and then be strong enough to pierce it. This rod tool is not supplied with the cartridge. There are a number of disadvantages to this, such as; not having a tool available; if a thin bead of material is needed an oversized tool will stretch out the smaller opening of the tip when inserted into the nozzle; forgetting to pierce the seal and over pressurizing the cartridge to the bursting point which could be quite dangerous to the user; wasting time having to locate or fashion a piercing tool; the piercing tool becomes covered with sticky uncured material after each use and must be cleaned or discarded, or if the tool is thin the seal must be pierced numerous times to provide a large enough opening in the seal for the material to flow out properly.

These disadvantages are well recognized and could be effectively eliminated by providing a leak proof self opening frangible seal for the interior opening of the nozzle that is both, sufficiently strong enough to remain intact from the internal pressure created in the cartridge during the filling operation, and, at the same time, sufficiently weak enough to allow the seal to fail and burst open from the additional pressure that can be brought to bear against the seal when the cartridge is pressurized by the application gun.

There have been several prior art patents granted for self opening cartridge type containers that offer similar and differing design solutions, materials and methods in attempting to provide this feature.

U.S. Pat. No. 2,646,906 to Jones describes a frangible cartridge nozzle seal comprised of a layer of polyethylene that is bonded over the nozzle opening. The seal bursts open in an undefined configuration when sufficient container pressure is created by advancing the interior piston of the cartridge with the application gun.

U.S. Pat. No. 3,029,987 to Gronemeyer describes a plastic cup shaped frangible sealing device that is inserted into the base of the nozzle and held by a flange. The partition wall end of the cup contains various scored v shaped groove configurations forming weakened sectors that rupture when sufficient container pressure is created by advancing the interior piston of the cartridge with the application gun.

U.S. Pat. No. 3,071,294 to Galbierz describes a frangible cartridge nozzle seal comprised of a layer of metal foil with a layer of polyethylene adhesive applied that allows the seal to be bonded over the nozzle opening and the seam where the nozzle flange joins the wall end cap of the cartridge. The seal bursts open in an undefined configuration when sufficient container pressure is created by advancing the interior piston of the cartridge with the application gun.

U.S. Pat. No. 6,578,737 to Jackman describes a cartridge nozzle seal comprised of foil that is burst open by being stretched and forced into cutting serrations located at the base of the dispensing nozzle when sufficient container pressure is created by advancing the interior piston of the cartridge with the application gun.

Each of these prior art patents present differing drawbacks in their method of operation, functionality, or the materials used such as; the use of a single layered polyethylene seal that bursts open in an undefined configuration when the cartridge is pressurized offers no provision for the possibility that seal material may break off and contaminate the contents of the cartridge when dispensed, such as described in U.S. Pat. No. 2,646,906 to Jones. The use of a cup shaped seal that is inserted into the nozzle and bursts open in the configuration of weakened grooves when the cartridge is pressurized requires an additional part that adds to the cost and complexity of the cartridge, such as described in U.S. Pat. No. 3,029,987 to Gronemeyer. The use of a single layer metal foil seal with a layer of adhesive that bursts open in an undefined configuration when the cartridge is pressurized offers no provision for the possibility that seal material may break off and contaminate the contents of the cartridge when dispensed, or that the burst pressure of the seal may vary beyond acceptable limits from inconsistencies formed in the adhesive layer from being heated during its installation, such as described in U.S. Pat. No. 3,071,294 to Galbierz. The use of a single layer metal foil seal with a layer of hot melt adhesive that bursts open when the seal is stretched and forced into serrated cutters at the base of the nozzle offers no provision for controlling the burst pressure of the seal which is determined by the tension left in the seal when the hot melt adhesive and metal foil cools which may cause the seal to prematurely burst from having too little tension to remain intact during the filling operation or from having too much tension that would cause the seal to burst at a pressure that is beyond acceptable limits, such as described in U.S. Pat. No. 6,578,737 to Jackman.

Consequently, a need still exists for a cartridge closure seal that overcomes the aforementioned drawbacks inherent in the prior art. The advantages of my invention include features such as, but not limited to; the ability to precisely control the burst pressure of the seal, the ability of the seal to retain any broken material when the seal bursts; its low cost; and its compatibility with existing cartridges, manufacturing equipment and methods. These and other features and advantages of my invention will become more readily apparent to those skilled in the art by a reading of the detailed description of the device when done in conjunction with the drawings shown in the illustrated embodiments of the invention.

SUMMARY OF THE INVENTION

The cartridge nozzle seal of the present invention is specifically concerned with the provision of effective means for sealing over the interior opening of the nozzle with a frangible seal that eliminates the disadvantages inherent in current cartridge design by providing a closure seal that automatically bursts open when a precise amount of internal cartridge pressure is reached when the cartridge is pressurized by an application gun while also retaining the frangible portion.

The principal advantages of the invention are achieved by utilizing a seal made up of a first layer of leak proof frangible sheet material that is bonded to an additional layer of sheet material that contains one or more cut through and/or cut out void configurations that forms a break and tear template. Bonding the template layer to the frangible layer strengthens the frangible layer every where except in the area of the breaking pattern where only the single frangible layer covers over the breaking pattern. This multi layered construction forces the frangible layer of the seal to break open and tear only in the weaker area of the breaking pattern when sufficient internal cartridge pressure is applied to the seal, while at the same time leaving the broken open central portion of the seal attached to the annular section of the seal remaining bonded to the periphery of the interior opening of the nozzle.

The principal feature of the invention is to provide a leak proof self opening frangible seal for the interior opening of the cartridge nozzle that is both, strong enough to remain intact when the seal is subjected to the pressure created in the cartridge during the filling operation and, also, weak enough to burst open when a certain amount of pressure is applied to the seal when a consumer cuts off the tip of the nozzle and pressurizes the cartridge with an application gun. This allows the seal to automatically burst open and dispense the contents out through the open nozzle when the cartridge is pressurized, thereby eliminating the need for a rod device to have to be inserted into the open nozzle to pierce the inner seal.

It is an object of the present invention to provide a closure seal for the interior opening of the nozzle of cartridge type containers that can be opened without the use of any type of tool.

It is a further object to provide a cartridge nozzle seal that automatically opens by increasing the pressure of the cartridge with the application gun.

It is a further object to provide a self opening cartridge nozzle seal that is adaptable to existing containers and nozzles and can be installed using existing sealing equipment and methods.

It is a further object to provide a cartridge nozzle seal that is economical to produce in large quantities using existing manufacturing equipment and methods.

It is a further object to provide a cartridge nozzle seal that can be automatically opened without any of the broken open portion of the seal material contaminating the container contents.

Another significant feature and object of the invention is to provide a container seal where the pressure required to open the seal is determined by the thickness of a frangible layer that is separate from the strengthening layer. This allows the breaking pressure of the seal to be precisely set by providing the ability to minutely increase or decrease the thickness of the frangible layer. The ability of the seal invention to fulfill these objectives provides a number of substantial advantages unmet in the prior art.

BRIEF DESCRIPTION OF THE DRAWINGS

Drawing

Drawing

Drawing

Drawing

Drawing

Drawing

Drawing

Drawing

Drawing

Drawing

Drawing

Drawing

Drawing

Drawing

REFERENCE NUMERALS IN DRAWINGS

| | |
|---|---|
| 30. | Seal. |
| 31. | Frangible layer. |
| 32. | First adhesive layer. |
| 33. | Template layer. |
| 34. | Second adhesive layer. |
| 35. | Breaking pattern. |
| 36. | Surface area. |
| 37. | Uncut areas. |
| 38. | Flaps. |
| 39. | Peripheral portion. |
| 40. | First nozzle type. |
| 41. | Cartridge. |
| 42. | Application gun. |
| 43. | Gun body portion |
| 44. | Gun nozzle end |
| 45. | Gun nozzle wall end |
| 46. | Gun trigger end. |
| 47. | Gun handle. |
| 48. | Gun trigger. |
| 49. | Gun plunger. |
| 50. | First nozzle wall end. |
| 51. | Cartridge tube. |
| 52. | Cartridge piston end. |
| 53. | Piston. |
| 54. | Cartridge nozzle end. |
| 55. | First nozzle opening. |
| 56. | First nozzle base. |
| 57. | First nozzle opening periphery. |
| 58. | Second nozzle cartridge wall end. |
| 59. | Second nozzle type. |
| 60. | Second nozzle wall end opening. |
| 61. | Second nozzle flange. |
| 62. | Second nozzle base. |
| 63. | Second wall end opening periphery. |
| 64. | Second nozzle opening periphery. |
| 65. | Second nozzle opening. |
| 66. | Strip A |
| 67. | Strip B. |

DETAILED DESCRIPTION OF THE PREFERRED EMBODIMENTS

Figure 1:
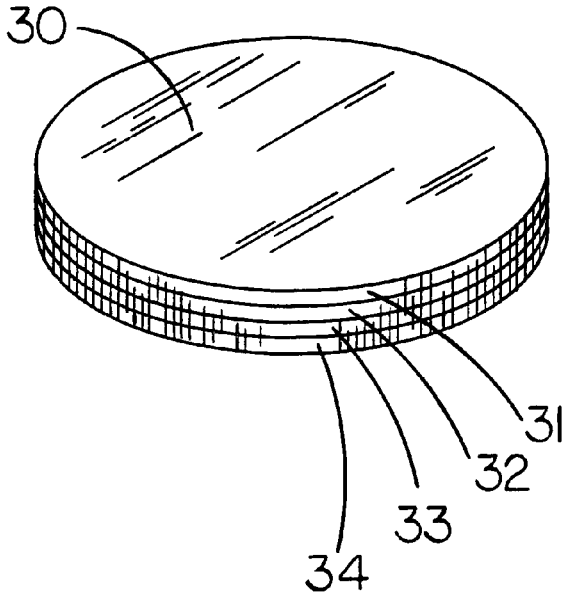
FIG. 1 illustrates a perspective view of a multi layered self opening frangible closure seal.

FIG. 1 illustrates a perspective view of a multi-layered self opening container closure seal 30 constructed in accordance with the present invention.

Figure 2:
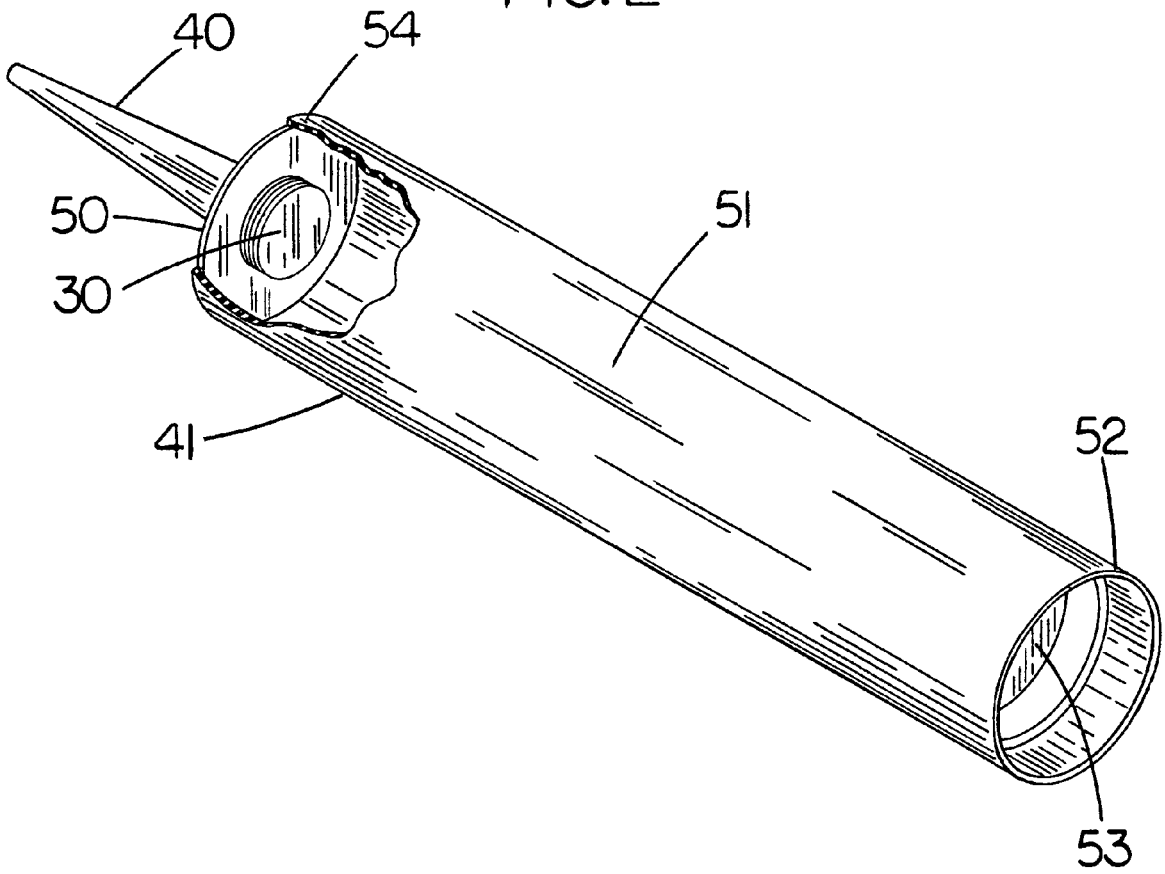
FIG. 2 illustrates a cutaway view of a cartridge type container used in combination with an application gun showing the seal invention bonded over the interior opening of the dispensing nozzle.

FIG. 2 illustrates a perspective view of the seal 30 that, when bonded over the interior opening 55 of the dispensing nozzle 40 of cartridge type containers 41 used for the storage and dispensing of sealants, adhesives, or lubricants and the like, and commonly known as a caulking cartridge 41, provides a leak proof frangible closure seal 30 that is automatically broken open in a defined configuration when the cartridge 41 is sufficiently pressurized in an application gun 42 and is herein referred to as the seal 30.

Figure 3:
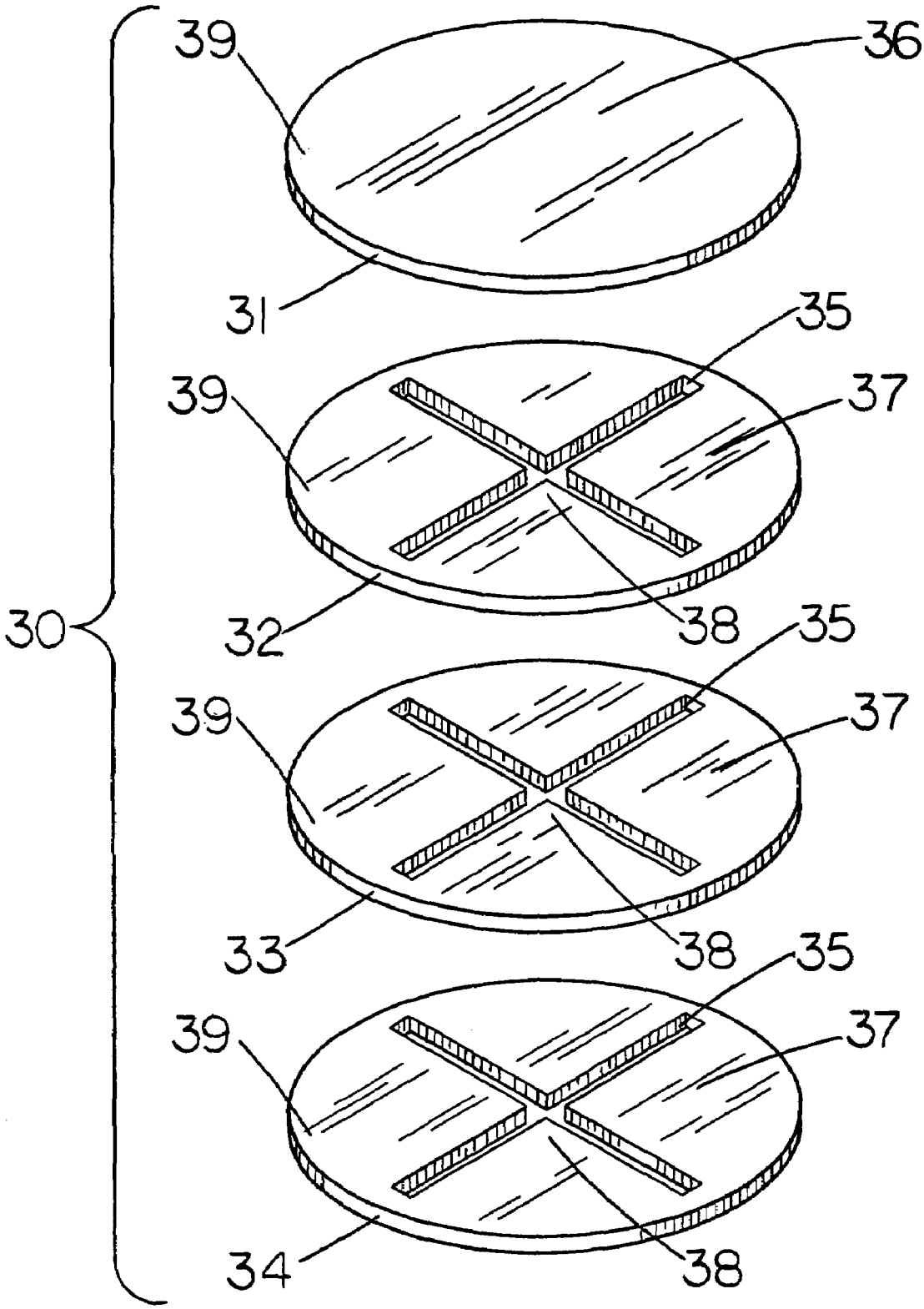
FIG. 3 illustrates an exploded view of the multi layered closure seal showing a top frangible layer that is bonded by a second adhesive layer to a third break and tear template layer with a fourth adhesive layer that bonds the seal over the interior opening of the cartridge nozzle.

FIG. 3 illustrates an exploded view of the seal 30 constructed of a first layer 31 of leak proof breakable material, herein referred to as the frangible layer 31, that consists of one or more layers of either; metal foil, polymers, plastic, paper, or combinations thereof. The frangible layer 31 is bonded by a second layer 32 of material, that consists of adhesive, to a third layer 33 of material that consists of one or more layers of either; metal foil, polymers, plastic, paper, adhesive, or combinations thereof and is herein referred to as the template layer 33. A fourth layer 34 of adhesive is applied to the template layer 33 enabling the seal 30 invention to be bonded over the interior opening 55 of the nozzle 40 of cartridge type containers 41 by various means such as, but not limited to; heat, ultrasonic, reactive, evaporative, pressure sensitive, or induction sealing as further shown in FIG. 2.

Figure 4:
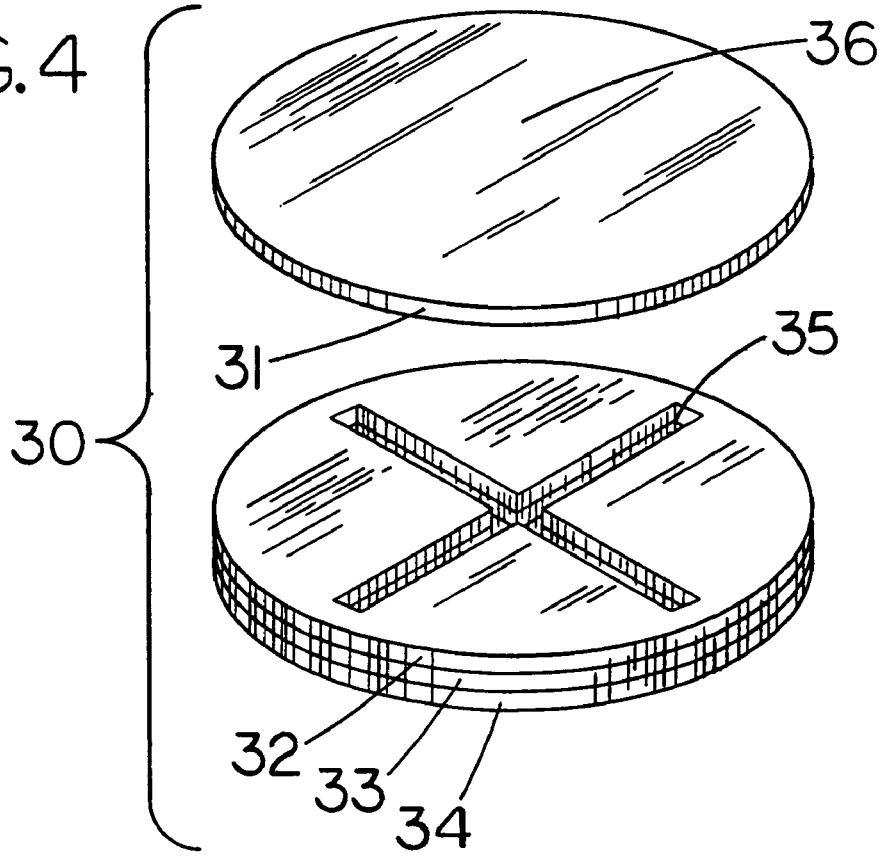
FIG. 4 illustrates a partially exploded view of the multi layered closure seal showing the top frangible layer before being bonded by the second adhesive layer, to the third template layer, and the fourth adhesive layer that each contain a cut through and/or cut out void configuration that forms a breaking pattern.

As further shown in the exploded view of FIG. 3, and the partially exploded view of FIG. 4, the template layer 33, together with the adhesive layers 32 and 34 respectively, contain a variable cut through and/or cut out void configuration and is herein referred to as the breaking pattern 35. The breaking pattern 35 can be cut into the template layer 33 that has either one or both of the adhesive layers 32 and 34 already applied, which allows duplicate breaking pattern 35 configurations to be cut into the template layer and either one or both of the adhesive layers 32 and 34 in a single step; or, after the breaking pattern 35 is cut into the template layer 33, either one or both of the adhesive layers 32 and 34 can be applied to the template layer 33 by various means known to those skilled in the art such as, but not limited to; spraying, rolling, or thin film application. In either process there is no adhesive spanning the cut through and/or cut out void area of the breaking pattern 35 configuration that has been cut into the template layer 33 as further shown in FIG. 4.

As further shown in FIG. 1, the frangible layer 31 is then bonded to the template layer 33 and the adhesive layer 34 by the adhesive layer 32 to form the substantially leak proof seal 30 that consists of multiple layers everywhere, except in the area of the breaking pattern 35, where the seal 30 consists of only the single frangible layer 31 that must be broken to break open the seal 30. This multi layered construction leaves the surface area 36 of the seal 30 relatively weaker only where the single frangible layer 31 covers over the area of the breaking pattern 35 configuration while making the remaining multi layered surface area 36 of the seal 30 relatively stronger.

Figure 5:
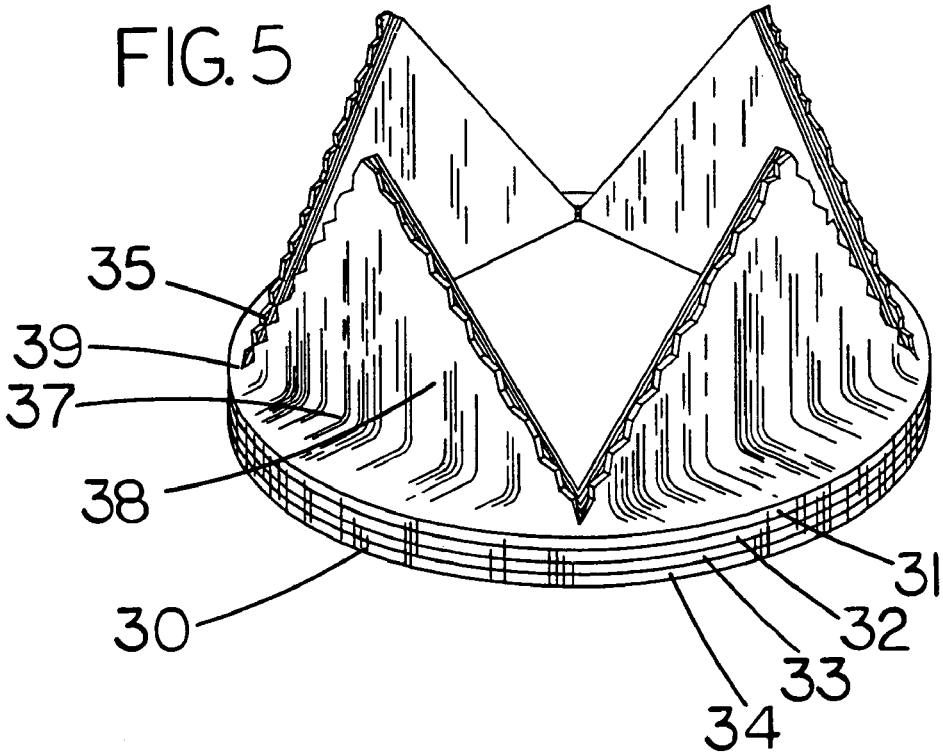
FIG. 5 illustrates a perspective view of the closure seal broken open in the configuration of the breaking pattern.

As shown in FIG. 5, the stronger-area weaker-area structure of the seal 30 forces the seal 30 to break open only in the weaker single frangible layer 31 area of the breaking pattern 35 configuration when sufficient internal cartridge pressure is brought to bear against the seal 30.

Figure 6:
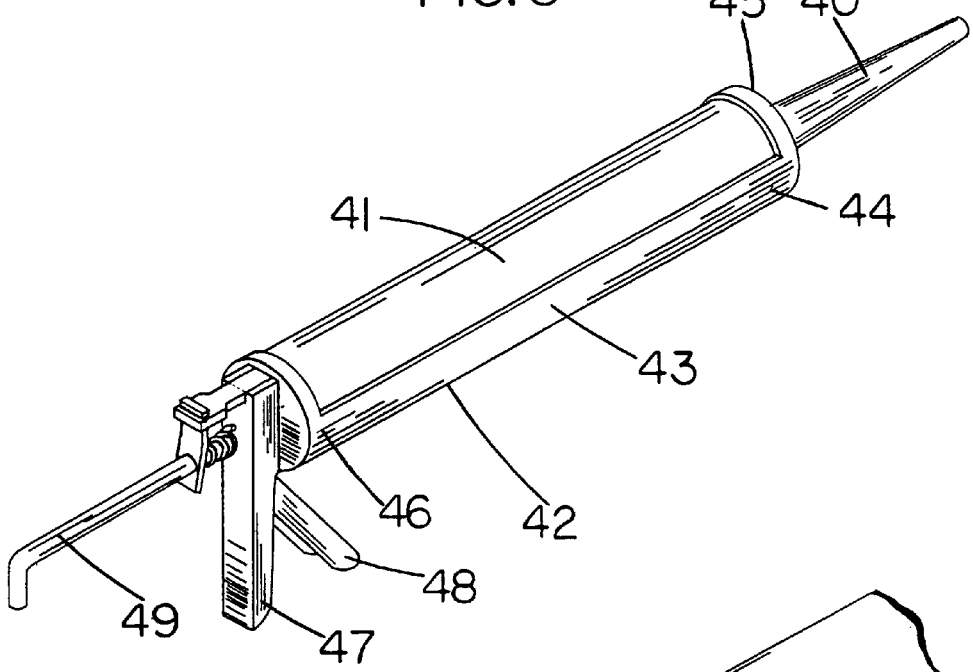
FIG. 6 illustrates a perspective view of the cartridge loaded into an application gun.

FIG. 6 illustrates the cartridge 41 loaded into an application gun 42 that consists of a body portion 43 with one end 44 incorporating a wall end 45 that butts up against and holds the cartridge 41 with an opening for the nozzle 40, and an opposite end 46 incorporating a handle 47 with a pull trigger 48 that when squeezed advances the plunger 49 which engages and advances the interior sliding piston 53 of the cartridge 41 thereby pressurizing the contents.

Figure 7:
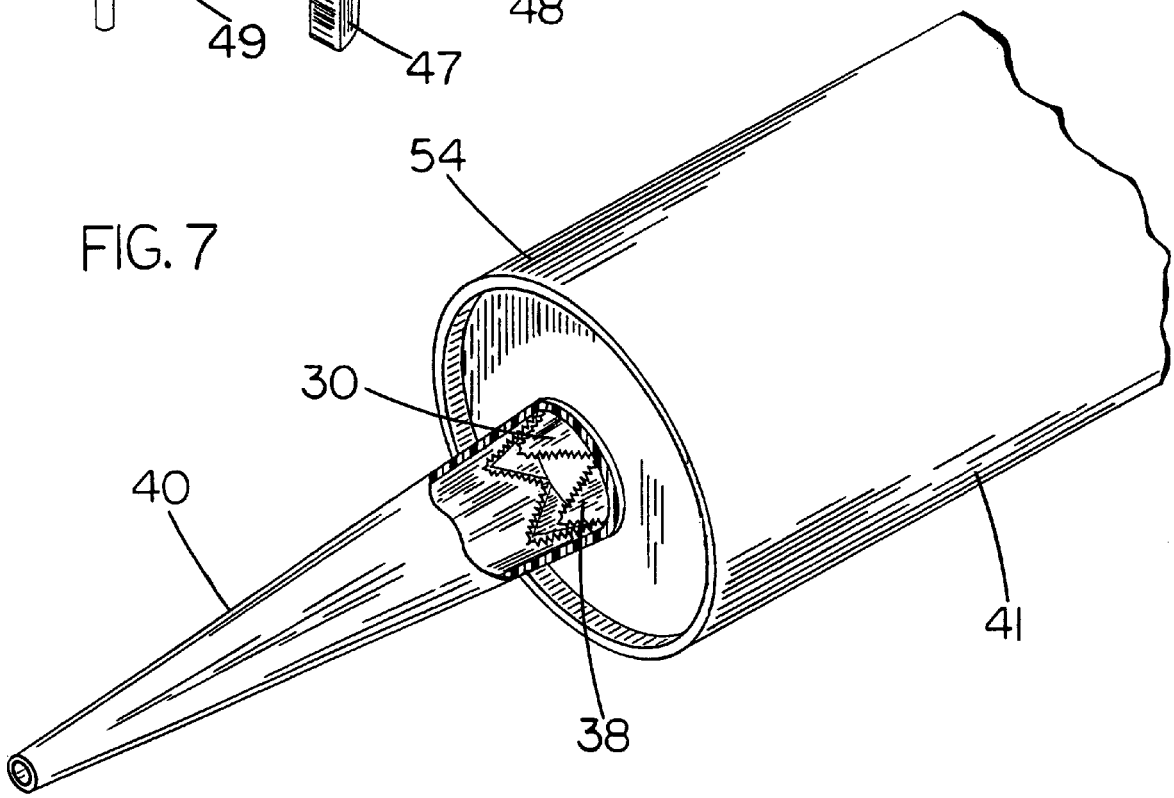
FIG. 7 illustrates a cutaway view of the interior opening of the cartridge nozzle showing the closure seal after bursting open in the configuration of the breaking pattern when the cartridge is sufficiently pressurized by an application gun.
Figure 8A:
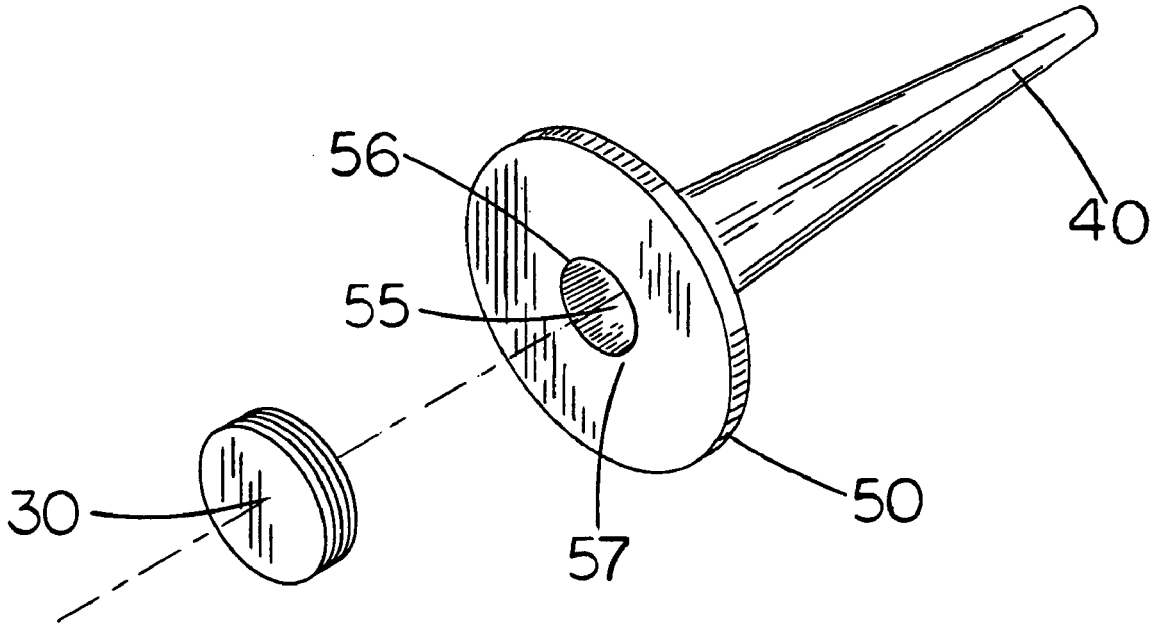
FIG. 8A illustrates an exploded view of a first embodiment of the seal wherein the nozzle and cartridge wall end are constructed as a single piece component.
Figure 8B:
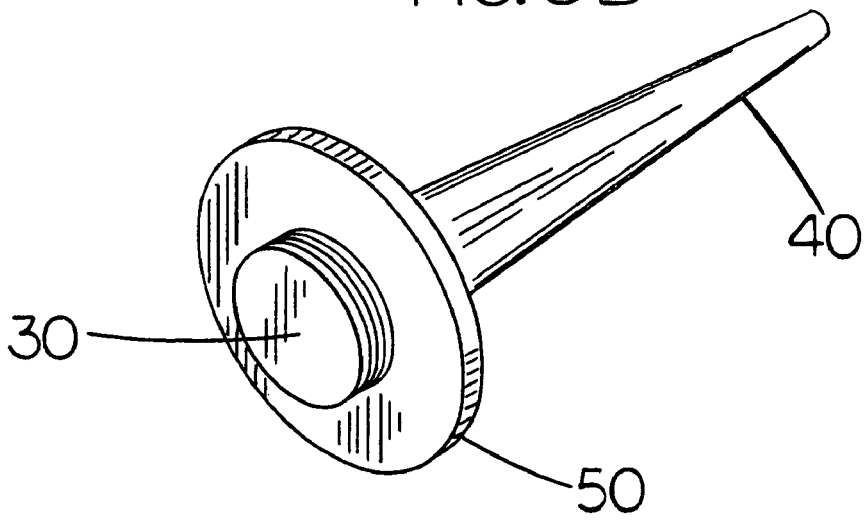
FIG. 8B illustrates a perspective view of the first embodiment of the seal bonded over the interior opening of the nozzle of the single piece nozzle and cartridge wall end component.

FIG. 7 illustrates that when the seal 30 is bonded over the interior opening 55 of the cartridge 41 dispensing nozzle 40 and the contents are sufficiently pressurized, the stronger-area weaker-area structure of the seal, forces the seal 30 to automatically break open outwardly inside the nozzle 40 only in the weaker single frangible layer 31 area of the breaking pattern 35 configuration thereby allowing the cartridge 41 contents to be dispensed out through the open tip of the nozzle 40.

As shown in FIG. 5, portions of the breaking pattern 35 include uncut areas 37 that serve a two fold purpose. First the uncut areas 37 act as hinges that allow the flaps 38 to swing open outwardly inside the nozzle 40 after being broken open and at the same time hold the flaps 38 in the open position. Secondly, the uncut areas 37 serve as connectors that keep the open flaps 38 from tearing away from the peripheral portion 39 of the seal 30 remaining bonded to the flat annular surface area 57 around the interior opening 55 of the nozzle 40 and contaminating the cartridge 41 contents when dispensed, as further shown in FIG. 7.

As shown in FIG. 2, FIG. 7, FIG. 8A and FIG. 8B, a first type of cartridge 41 construction incorporates a single piece wall end 50 and nozzle 40 component. The cartridge 41 is comprised of a hollow cylindrical tube 51 sealed at one end 52 by a sliding interior piston 53 with an opposite end 54 sealed by a wall end 50 that incorporates an integral hollow exterior dispensing nozzle 40 with an interior opening 55 at its base 56 where the nozzle 40 is joined to the wall end 50 providing a flat annular interior surface area 57 of the wall end 50 around the periphery of the interior opening 55 of the nozzle 40 providing means for the seal 30 to be bonded over the interior opening 55 of the dispensing nozzle 40 as further shown in FIG. 8A and FIG. 8B.

Figure 9A:
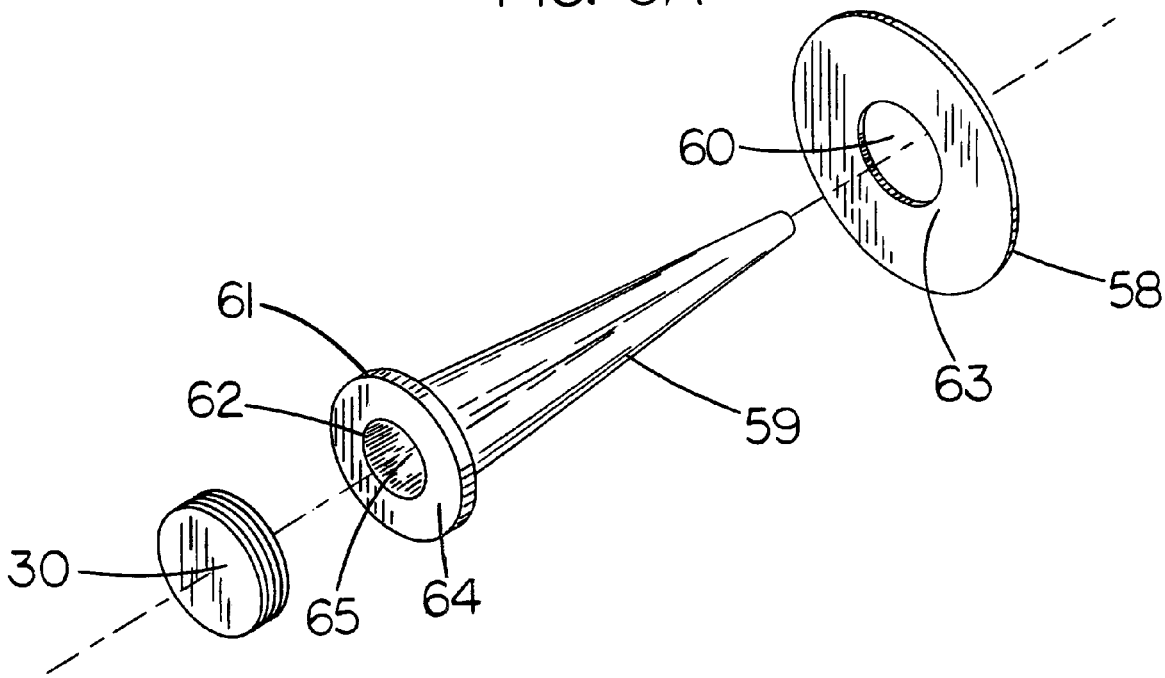
FIG. 9A illustrates an exploded view of a second embodiment of the seal wherein the nozzle and cartridge wall end are constructed as a two or more piece component.
Figure 9B:
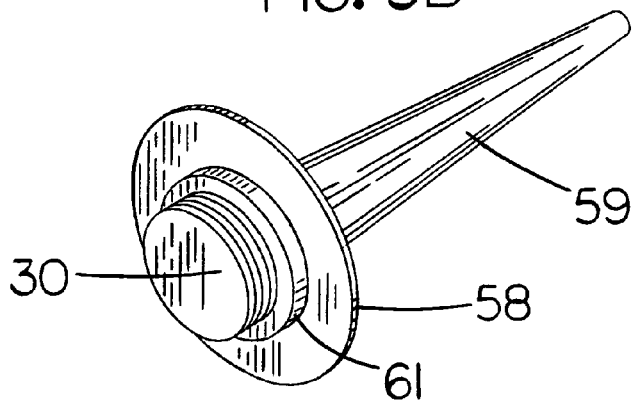
FIG. 9B illustrates a perspective view of the second embodiment of the seal bonded over the interior opening of the nozzle of the two or more piece nozzle and cartridge wall end component.

In a second embodiment, as shown in FIG. 9A and FIG. 9B, a second type of cartridge 41 construction incorporates a two or more piece wall end 58 and nozzle 59 component. The cartridge 41 is again comprised of a hollow cylindrical tube 51 sealed at one end 52 by a sliding interior piston 53, but with the opposite end 54 sealed by wall end 58 that incorporates a separate hollow exterior dispensing nozzle 59 with an interior opening 65 at its base 62 that is inserted and press fit into an opening 60 from the inside of the wall end 58 and held in place and kept from leaking or being ejected when the cartridge 41 is pressurized by an circular flange 61 surrounding the outside base of the nozzle 59. In a first capacity the flange 61 serves as a seat that seals the nozzle 59 to the wall end 58 by being increasingly pressed against the interior surface area 63 of the wall end 58 surrounding the nozzle 59 insert opening 60 as the internal pressure of the cartridge 41 contents increases. In a second capacity the flange 61 provides a flat annular interior surface area 64 around the periphery of the interior opening 65 of the nozzle 59 where the seal 30 is bonded over the interior opening 65 of the dispensing nozzle 59 as further shown in FIG. 9A and FIG. 9B.

In either of the embodiments described herein, the object of the invention is to provide a substantially leak proof closure seal 30 for the interior opening 55 or 65 of the cartridge 41 dispensing nozzle 40 or 59 that is automatically broken open outwardly inside the nozzle 40 or 59 when sufficient internal pressure is created by a user loading the cartridge 41 into an application gun 42 and advancing the sliding interior piston 53 with the plunger 49 of the application gun 42, thereby eliminating the need for a rod or tool device to have to be inserted into the open tip of the nozzle 40 or 59 to pierce the inner seal.

When the seal 30 is bonded over the interior opening 55 or 65 of the cartridge 41 nozzle 40 or 59, the seal 30 is only sufficiently strong enough to remain intact from the pressure created from the filling operation of the cartridge 41 or its subsequent shipping and handling.

When the cartridge 41 contents are pressurized by a user advancing the sliding interior piston 53 of the cartridge 41 with the plunger 49 of the application gun 42, the seal 30 is sufficiently weak enough to automatically break open outwardly inside the nozzle 40 or 59 only in the configuration of the breaking pattern 35 from the additional pressure created, allowing the contents to dispense out through the open tip of the nozzle 40 or 59 as further shown in FIG. 7.

The breaking pattern of the template layer 33 may be cut in a plurality of different configurations, such as, but not limited to, the configurations shown in FIGS. 10A thru 10H. It is to be recognized that the configuration of the breaking pattern shown in the drawing FIGS. 3, 4, 5, 7, 11A, and 11B, though preferred, is used to illustrate the function of the seal 30 and not to limit the embodiments only to the configuration of the breaking pattern shown.

Figure 10:
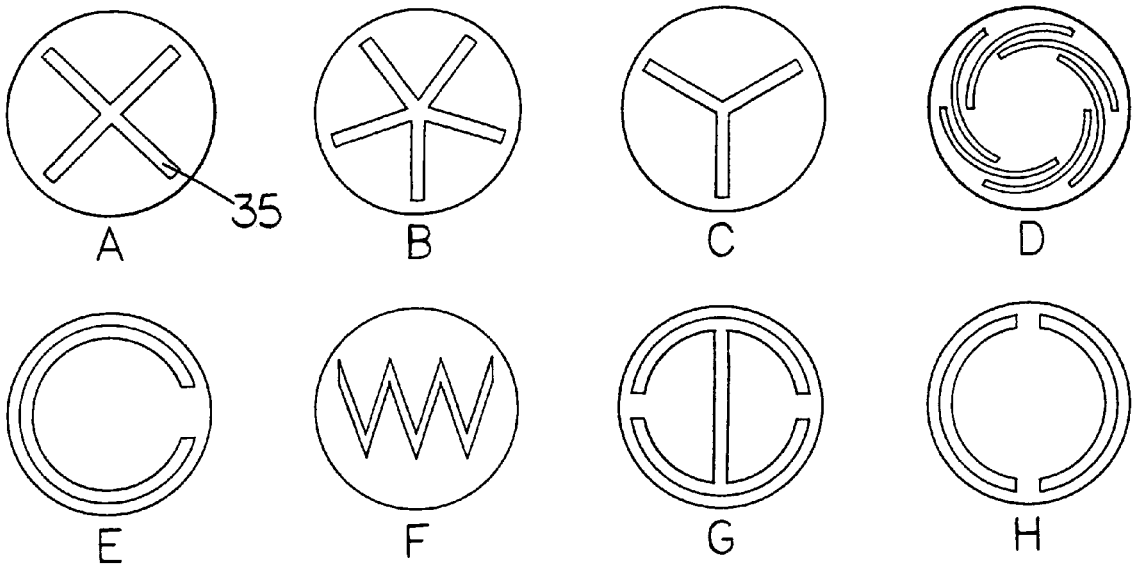
FIG. 10 illustrates a plurality of breaking pattern configurations adaptable for use as the template layer breaking pattern.
Figure 11A:
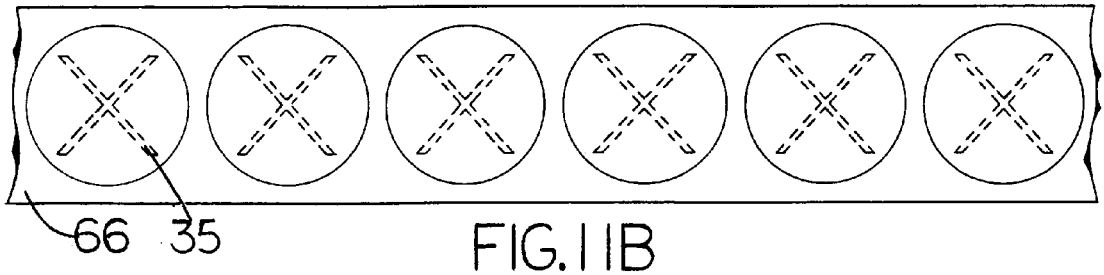
FIG. 11A illustrates an outline of the seal disk to be cut out of a strip of the multi layered seal material wherein a single repeating breaking pattern, shown in the hidden view, is substantially centered within the circumference of the disk.

As shown in FIG. 11A, using the breaking pattern 35 as shown in FIG. 10A, the seal 30 disk can be cut out of a strip 66 of the multi layered seal material that contains, but is not limited to, any one of the breaking pattern configurations shown in FIGS. 10A thru 10H, wherein the disk cutter is in register with each individual breaking pattern 35, and cuts out the seal 30 disk with a single breaking pattern 35 substantially centered within the circumference of the seal 30 disk, as further shown in the hidden view in FIG. 11A.

Figure 11B:
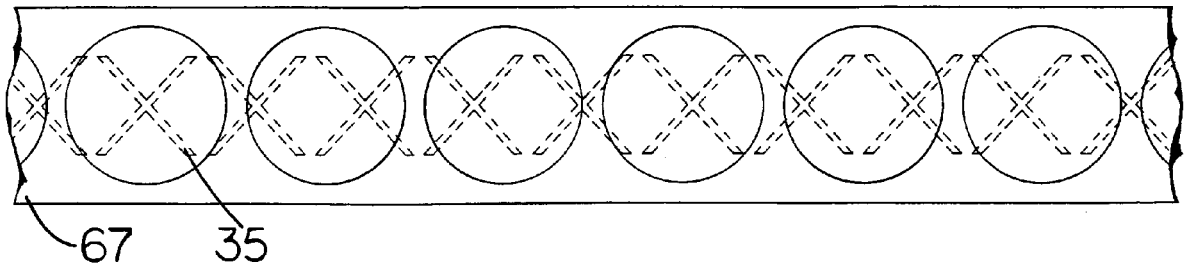
FIG. 11B illustrates an outline of the seal disk to be cut out of a strip of the multi layered seal material wherein the repeating breaking patterns, shown in the hidden view, are in close enough proximity to one another to allow the seal disk to be cut out at any point along the strip and contain enough of one or more the breaking patterns within the circumference of the disk to allow the seal, when installed, to function as intended.

As shown in FIG. 11B, using the breaking pattern 35 as shown in FIG. 10A, the seal 30 disk may also be cut out of a strip 67 of the multi layered seal material wherein the breaking pattern 35 is repeated in the strip 67 in close enough proximity to one another to allow the seal 30 disk to be cut out of the strip 67 at any point along the strip 67 and contain enough of one or more of the repeating breaking patterns 35 within the circumference of the seal 30 disk for the seal 30, when bonded over the interior nozzle openings 55 or 65, to function as intended as further shown in the hidden view in FIG. 11B.

The pressure required to break open the seal 30 when bonded over the interior nozzle openings 55 or 65 can be adjusted by: increasing or decreasing the thickness of the material used in the frangible layer 31; by the choice of material used in the frangible layer 31; by the dimensions or the configuration of the breaking pattern used in the template layer 33; or combinations of one or more of these methods.

The template layer 33 side of the seal 30 may be bonded over the interior nozzle openings 55 or 65 as described herein, or alternately, the frangible layer 31 side of the seal 30 may also be bonded over the interior nozzle openings 55 or 65 by the application of adhesive to the frangible layer 31 only around the periphery 39 of the frangible layer 31 where the seal 30 contacts the bonding areas 57 or 64 around the periphery of the interior nozzle openings 55 or 65, or by the application of the adhesive to the bonding areas 57 and 64 around the periphery of the interior openings 55 or 65 of the nozzle itself.

The adhesive layer 34 can be eliminated when either; the seal 30 is to be bonded over the interior nozzle openings 55 or 65 by the application of the adhesive to the bonding areas 57 or 64 around the periphery of the interior nozzle openings 55 or 65 of the nozzle itself; or the frangible layer 31 side of the seal 30 is to be bonded over the interior nozzle openings 55 or 65.

The adhesive layer 32 can be eliminated when the frangible layer 31 is to be bonded directly to the template layer 33 by various means known to those skilled in the art such as, but not limited to, cladding or fusion bonding and the like.

When the template layer 33 consists of adhesive, the adhesive layer 32, the template layer 33, and the adhesive layer 34 can be combined and applied to the frangible layer 31 in a single process. When the combined layers of adhesive are applied to the frangible layer 31, the breaking pattern 35 is formed by leaving an area in the configuration of the breaking pattern 35 uncoated with the adhesive. This leaves the surface area 36 of the multi layered seal 30 relatively weaker only in the uncoated area of the single frangible layer 31 while making the coated area of the frangible layer 31 relatively stronger which forces the seal 30, when bonded over the nozzle openings 55 or 65, to break open and tear only in the single weaker frangible layer 31 area of the breaking pattern 35 configuration.

The adhesive layers 32 and 34 may consist of one or more layers of the same or different types of adhesives such as, but not limited to, hot melt adhesives of the same or differing bonding temperatures, one or more part reactive adhesives, evaporative adhesives, micro encapsulated adhesives, or pressure sensitive adhesives that may incorporate an additional protective peel off layer that is removed after the breaking pattern 35 is cut into the adhesive layer 32, the template layer 33, and the adhesive layer 34 in a single step, allowing the frangible layer 31 to be then applied to the template layer 33 by pressure.

One or more template layers 33 may be bonded to both sides of the frangible layer 31 or, alternately, one or more frangible layers 31 maybe bonded to both sides of the template layer 33. For purposes of illustration no cartridge filler material is shown in the drawings.

Although the present invention has been described in terms of specific embodiments thereof, the invention claimed is not so restricted. It will be apparent to those skilled in the art that it is possible to modify and alter features of the invention without departing from the spirit or scope of the inventive concept. Variations of the embodiments may be made without departing from the invention in its broader aspect such as: various breaking pattern configurations not shown in the drawings may also be used; various other materials not described herein may be substituted for the seal layers; various other adhesives not described herein may be adopted; the construction of the cartridge may vary from the illustrations; the cartridge may contain additional types of flowable material etc.

Thus the scope of the invention should be determined by the appended claims and their legal equivalents, rather than by the examples given.

Thus having described the invention, I claim:

1. A leak proof pressure activated self opening closure seal for sealing over an interior nozzle opening of a cartridge type container used for dispensing flowable material when said cartridge is pressurized by an application gun;

(a) said cartridge type container comprising:

a hollow cylindrical tube sealed at one end by a sliding interior piston; an opposite end sealed by a wall end; said wall end incorporating a hollow exterior dispensing nozzle with an interior opening in its base; said interior opening having a peripheral surface area extending radially around said interior opening perpendicular to the bore of said nozzle providing a planar surface for bonding said closure seal over said interior opening of said nozzle of said wall end of said cartridge type container;

(b) said closure seal comprising:

a first layer of frangible sheet material, a second layer of adhesive, a third layer of strengthening sheet material, a fourth layer of adhesive;

(c) wherein said second layer of adhesive, said third layer of strengthening sheet material and said fourth layer of adhesive each contain a duplicate cut out void configuration that are in alignment with each other;

(d) wherein said first layer of frangible sheet material, said second layer of adhesive, said third layer of strengthening sheet material, and said fourth layer of adhesive are permanently laminated together forming said closure seal;

(e) wherein said duplicate cut out void configuration creates a weak area in said closure seal by leaving only said first layer of frangible sheet material covering over said duplicate cut out void configuration;

(f) wherein an annular portion of said closure seal is bonded to said peripheral surface area of said dispensing nozzle of said wall end by said fourth layer of adhesive sealing over said interior opening of said dispensing nozzle of said cartridge type container;

(g) wherein said closure seal is of sufficient strength to remain intact and retain said flowable material in said cartridge type container when said cartridge type container is filled with said flowable material;

(h) wherein said closure seal is of sufficient weakness to break open only in said weak area of said duplicate cut out void configuration thereby allowing said flowable material to dispense out from said dispensing nozzle when said cartridge type container is pressurized by said application gun.

2. The duplicate cut out void configuration of claim 1, wherein said duplicate cut out void configuration includes one or more uncut portions that connect one or more broken open center flaps of said closure seal to the annular portion of said closure seal remaining bonded to said peripheral surface area around said interior opening of said dispensing nozzle thereby preventing said one or more broken open center flaps from tearing from said peripheral surface area when said closure seal breaks open.

3. The duplicate cut out void configuration of claim 1, wherein said duplicate cut out void configuration can comprise either a: varied C shaped, H shaped, three or more point star shaped, X shaped, wave shaped, spiral shaped, or circular shaped configuration.

4. The closure seal of claim 1, wherein said annular portion of said closure seal is bonded to said peripheral surface area by: induction sealing; heat sealing; evaporative sealing; reactive sealing; or ultrasonic sealing.

5. The first layer of frangible sheet material of claim 1, wherein said first layer of frangible sheet material is made up of one or more layers of same or different materials, wherein said materials are: metal foil; polymers; plastic; or paper.

6. The third layer of strengthening sheet material of claim 1, wherein said third layer of strengthening sheet material is made up of one or more layers of same or different materials wherein said materials are: metal foil; polymers; plastic; paper or adhesive.

7. The first layer of frangible sheet material of claim 1, wherein said first layer of frangible sheet material is permanently laminated to said third layer of strengthening sheet material by non adhesive means, wherein said non adhesive means comprise cladding or fusion bonding.

8. The flowable material of claim 4, wherein said flowable material can be one of, adhesives; sealants; lubricants; chemicals or foodstuffs.

9. A leak proof pressure activated self opening closure seal for sealing over the interior opening of the hollow dispensing nozzle of a cartridge type container used for storing and dispensing flowable material when pressurized by an application gun; said closure seal comprising;

(a) a layer of frangible sheet material is bonded to a layer of strengthening sheet material; said layer of strengthening sheet material containing a cut out void configuration;

(b) wherein bonding means bonding said layer of frangible sheet material to said layer of strengthening sheet material includes an area void of said bonding means that duplicates said cut out void configuration in said layer of strengthening sheet material;

(c) wherein said cut out void configuration creates a weak area in said closure seal by leaving only said layer of frangible sheet material covering over said cut out void configuration;

(d) wherein the annular portion of said leak proof pressure activated self opening closure seal is bonded over said interior opening of said dispensing nozzle sealing over said interior opening; said closure seal being of sufficient strength to remain intact when subjected to the internal pressure created in said cartridge during the filling of said cartridge with said flowable material;

(e) wherein said closure seal is of sufficient weakness to break open only in said weak area of said cut out void configuration thereby allowing said flowable material to dispense out from said dispensing nozzle when said cartridge type container is pressurized by said application gun;

(f) wherein said cut out void configuration includes one or more uncut portions that connect one or more broken open center flaps of said closure seal to the annular portion of said closure seal remaining bonded to a planar surface area surrounding said interior opening of said dispensing nozzle thereby preventing said one or more broken open center flaps from tearing from said annular portion when said closure seal breaks open;

(g) wherein said bonding means bonding said closure seal over said nozzle opening includes an area void of said bonding means that duplicates said cut out void configuration in said second layer of strengthening sheet material;

(h) wherein the said layer of frangible sheet material side of said closure seal is bonded over said interior opening of said dispensing nozzle;

(i) wherein the said layer of strengthening sheet material side of said closure seal is bonded over said interior opening of said dispensing nozzle;

(j) wherein said layer of frangible sheet material is comprised of one or more layers of same or different materials wherein said materials are: metal foil; plastic; polymers; or paper;

(k) wherein said layer of strengthening sheet material is comprised of one or more layers of same or different materials wherein said materials are: metal foil; plastic; polymers; paper; or adhesive;

(l) wherein the bursting pressure of said closure seal is can be regulated by varying the thickness of said first layer of frangible sheet material;

(m) wherein said flowable material includes either one of; adhesives; sealants; lubricants; chemicals or foodstuffs.

* * * * *